US007243915B2

(12) United States Patent
Wong et al.

(10) Patent No.: US 7,243,915 B2
(45) Date of Patent: Jul. 17, 2007

(54) INPUT/OUTPUT TRAYS FOR HARDCOPY DEVICE

(75) Inventors: Howard G. Wong, Portland, OR (US); Peter Hwang, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 10/700,806

(22) Filed: Nov. 3, 2003

(65) Prior Publication Data

US 2005/0104280 A1 May 19, 2005

(51) Int. Cl.
*B65H 85/00* (2006.01)

(52) U.S. Cl. ..... 271/3.14; 271/162; 271/163; 347/104; 399/107

(58) Field of Classification Search ..... 271/3.14, 271/162, 163; 347/104; 400/693; 358/1.12; 399/107, 391, 392, 393, 405
See application file for complete search history.

(56) References Cited

U.S. PATENT DOCUMENTS

| | | | | |
|---|---|---|---|---|
| 6,113,093 | A * | 9/2000 | Morinaga et al. | 271/162 |
| 6,152,630 | A * | 11/2000 | Scarton et al. | 400/642 |
| D483,060 | S * | 12/2003 | Wong et al. | D18/50 |
| 6,824,129 | B2 * | 11/2004 | Sides, II | 271/3.14 |
| 6,830,401 | B1 * | 12/2004 | Hwang et al. | 400/693 |
| 6,848,685 | B2 * | 2/2005 | Katsuyama | 271/162 |
| 2003/0052956 | A1 * | 3/2003 | Katsuyama | 347/108 |
| 2005/0094227 | A1 * | 5/2005 | Hwang et al. | 358/498 |

FOREIGN PATENT DOCUMENTS

| | | |
|---|---|---|
| JP | 4-319463 | * 11/1992 |
| JP | 5-77507 | * 3/1993 |

* cited by examiner

*Primary Examiner*—Patrick Mackey
*Assistant Examiner*—Thomas Morrison

(57) ABSTRACT

The illustrated input and output trays are pivotally attached to the hardcopy device and are movable between a processing position and a storage position.

14 Claims, 6 Drawing Sheets

INPUT/OUTPUT TRAYS FOR HARDCOPY DEVICE

BACKGROUND OF THE INVENTION

Hard copy devices process images on media, typically taking the form of printers, scanners, plotters (employing inkjet or electron photography imaging technology), facsimile machines, laminating devices, and various combinations thereof, to name a few. These hardcopy devices typically transport media in a sheet form from a media supply of cut sheets to an interaction zone where scanning, printing, or post-print processing, such as laminating, overcoating or folding occurs. The processed sheets are usually then transported to an output area such as a tray.

Proper positioning of the media in the media supply, such as an input tray, is a first step in correctly feeding the media through the hardcopy device. Many hardcopy devices utilize an external media input tray that is designed to accept media of different sizes, depending upon the user's needs, and to hold the media in the proper position relative to the media drive mechanisms. External input trays typically include media alignment devices or indicia to indicate to the user the proper positioning of the media in the media supply. After media is fed through the printzone it is often output to an external output tray.

External input and/or output trays add a significant amount of space required for the hardcopy device. For example, in the case of a printer that resides on a user's desktop, external media input and output trays tend to take up a significant amount of desk space.

DETAILED DESCRIPTION

In hardcopy devices such as printers, plotters (employing inkjet or electron photography imaging technology), facsimile machines, etc. it is to maintain proper relative position between the print devices (such as inkjet cartridges) and the media to effect high-resolution, high-quality printing. As a first step in the proper positioning of cut sheet media in a hardcopy device, the media must be properly oriented on a media input device so that the media is fed into the media drive mechanisms in the correct position in order that the media is oriented correctly relative to the media feed and print mechanisms.

Figure 1:
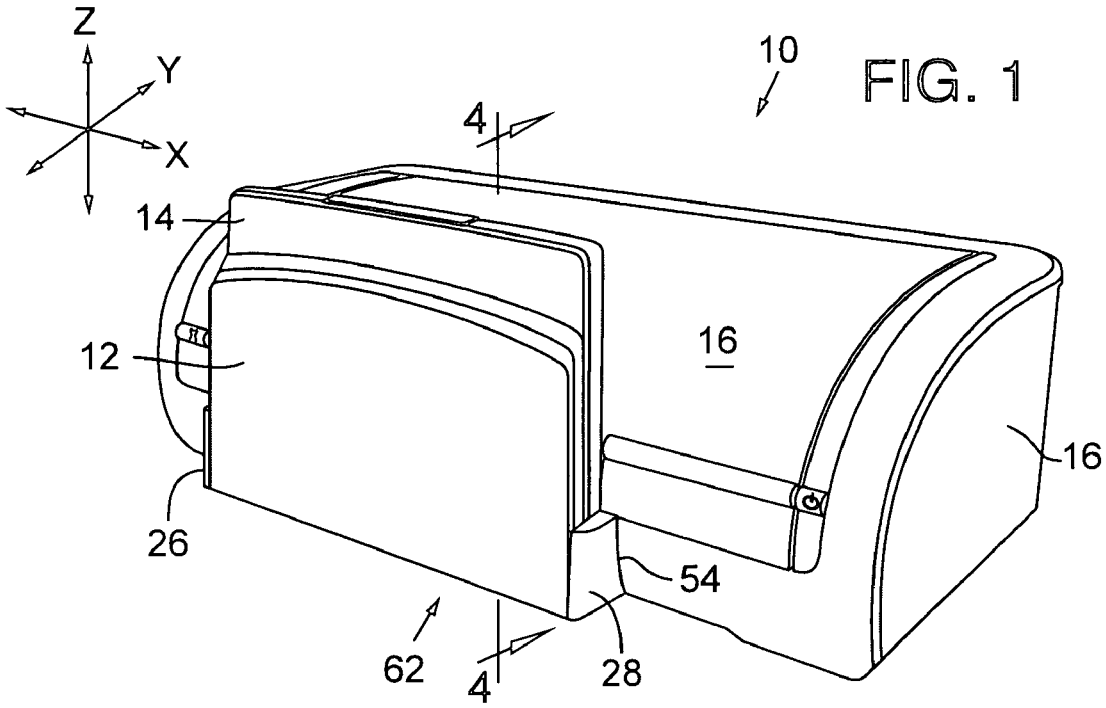
FIG. 1 is a semi-schematic perspective view of a hardcopy device, here for the purposes of illustration shown as an inkjet printer, illustrating foldable media input tray and output trays according to one embodiment, with both the input and output trays folded into a storage position.

With reference to FIG. 1, a hardcopy device is shown as an inkjet printer 10 utilizing an external media input tray 12 and an external media output tray 14 that is positioned above input tray 12. As described in greater detail below, both input tray 12 and output tray 14 are pivotally attached to the a tray assembly 62, which is slidably inserted into the housing 16 of printer 10.

Media advancement through printer 10 is generally accomplished with friction rollers that pick individual sheets of cut media from the input tray 12, advance the media along a feed path through a "printzone" where ink is applied to the media, and output the media after printing to the output tray 14. For purposes of clarity and to illustrate details of the example illustrated embodiment of the invention more clearly, many features of the of inkjet printer 10, including the media drive components are omitted from the figures. Moreover, the internal structures utilized in printer 10 are not illustrated. And although an example embodiment of the invention is illustrated as an inkjet printer, it will be understood that the invention may be embodied in numerous different types of hardcopy devices that utilize external input and output trays.

As a convention for certain terms used herein, directional words such as "right" and "left", "above" and "below" are based on viewing the printer 10 from the general position of the viewer in FIG. 1—that is, viewing printer 10 from the front, or tray side. Furthermore, the "X" axis is defined as the axis along which inkjet cartridges contained in housing 16 reciprocate. The "Y" axis is transverse to the X axis, and is the axis of media travel as the media is fed into the printer and through a printzone, which in the case of an inkjet printer the area where ink is applied to the media. And the "Z" axis is the axis that extends vertically upward relative to the ground plane. These three axes are illustrated with an XYZ coordinate axis in the drawings.

Figure 2:
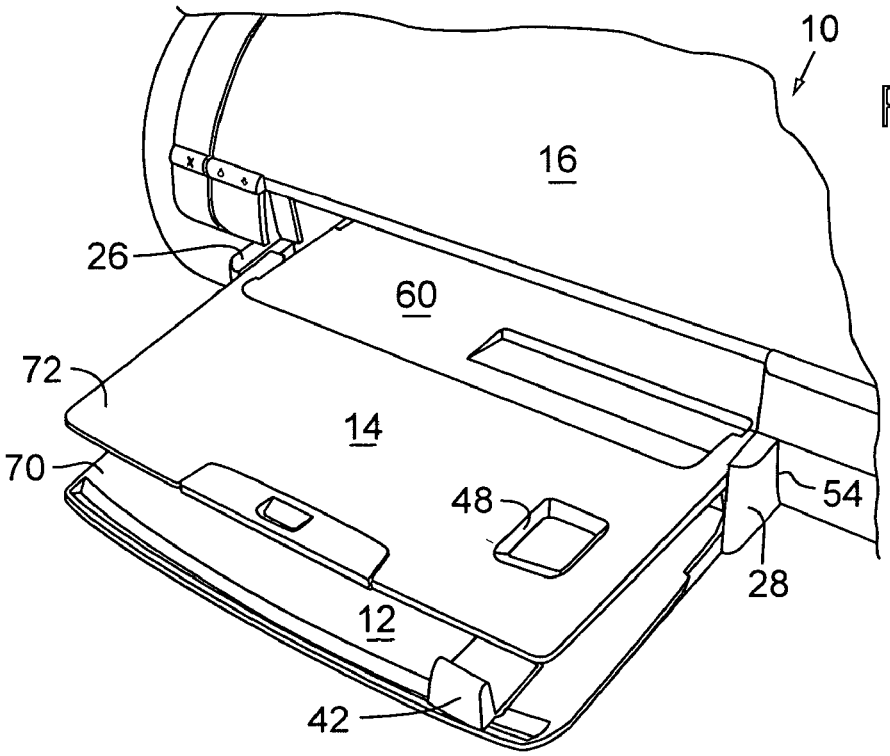
FIG. 2 is a semi-schematic perspective and partially cut away view of the hardcopy device illustrated in FIG. 1, showing both the input and output trays in the in-use position.
Figure 3:
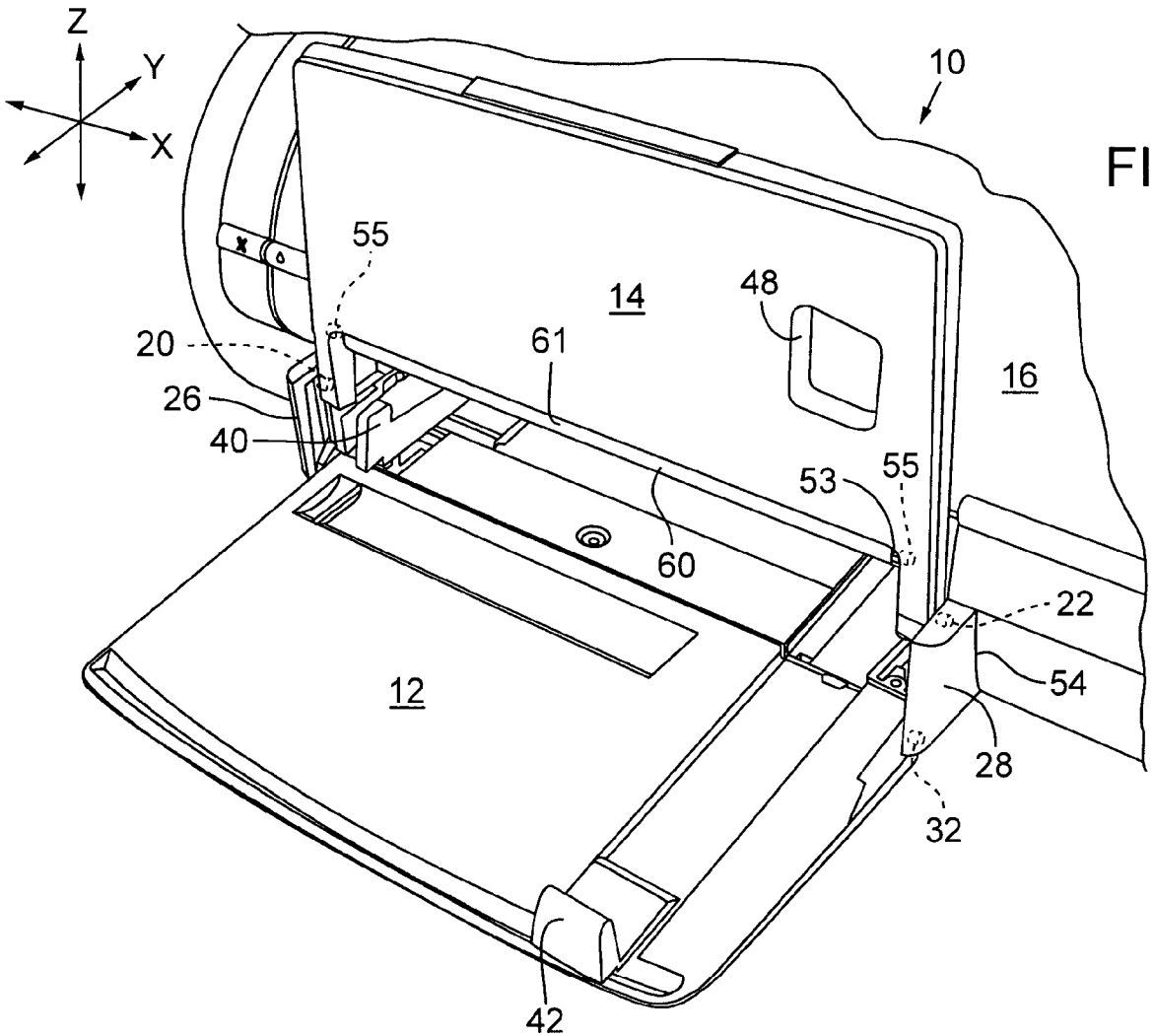
FIG. 3 is a semi-schematic perspective view of the hardcopy device illustrated in FIG. 2 in which the output tray has been folded up into the storage position and the input tray is in the in-use position.

Turning to FIG. 2, media input tray 12 is located beneath output tray 14 in the inkjet printer 10 when the trays are lowered into the "in-use" position shown in FIG. 2. The in-use position, also referred to herein as the "media processing position," is the position in which the input and output trays are placed during printing processing operations. The in-use position may be contrasted with the "storage" position shown in FIG. 1, in which both the input tray 12 and the output tray 14 are pivoted upwardly about their respective attachments to tray assembly 62 and rest adjacent housing 16. It will be appreciated that when the trays 12 and 14 are placed in the storage position shown in FIG. 1, printer 10 is configured so that it occupies a smaller "footprint" than in the FIG. 2 configuration. With reference to FIGS. 1, 2 and 3, both input tray 12 and output tray 14 are independently and pivotally mounted so that the trays 12 and 14 are movable between the in-use position, and the storage position. This pivotal movement is shown with arrow A in FIG. 4.

Figure 4:
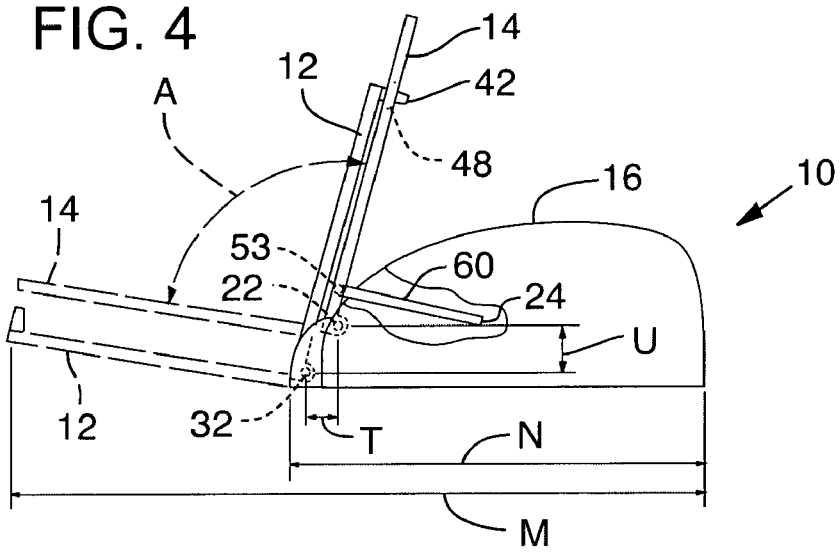
FIG. 4 is a cross sectional, partially cut away side elevation view of the hardcopy device illustrated in FIG. 1, and taken along the line 4-4 of FIG. 1, illustrating the media input and output trays flipped up into a storage position in solid lines and in an in-use position in phantom lines.
Figure 5:
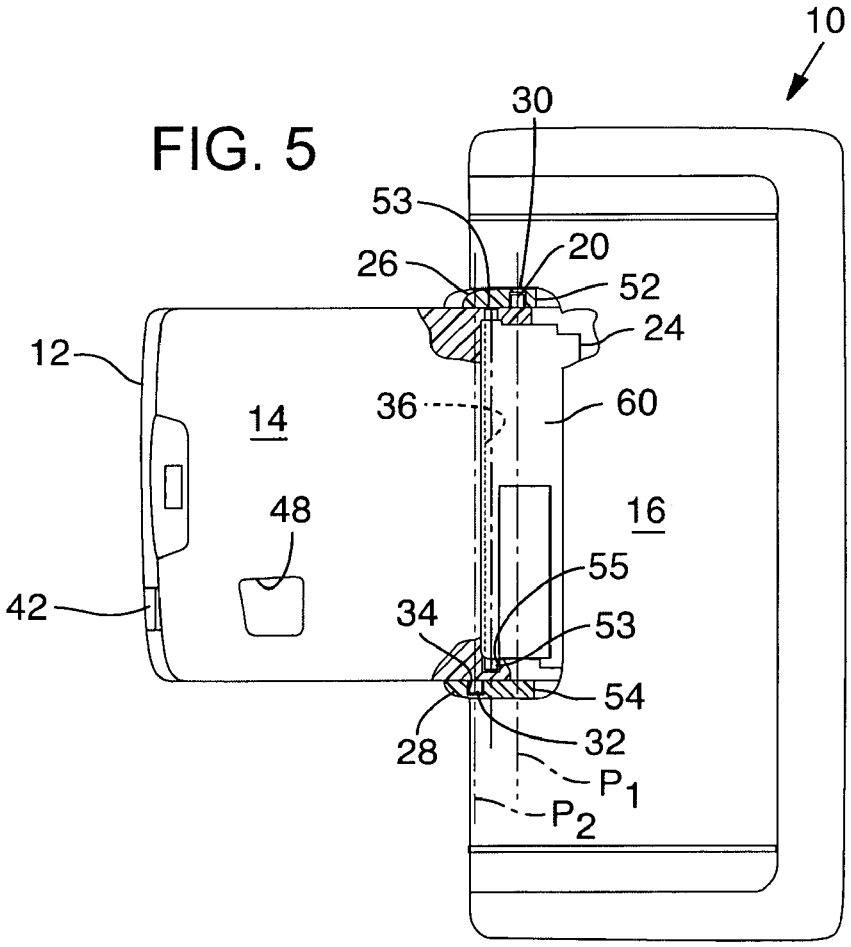
FIG. 5 is a top plan view of the hardcopy device illustrated in FIG. 4 and showing in partial cross section and in partial cut-away section the media input and output tray attachments to the printer housing.

With reference now to FIGS. 4 and 5, tray 14 includes a pair of outwardly facing bosses, 20 and 22, one on each of the outer lateral edges of the tray in proximity to the forward edge 24 of the tray. A pair of cheeks, 26 and 28, each of which defines a mounting support for the input and output trays 12 and 14, are attached to a tray assembly 62, which is described below and which may be inserted into printer 10. When the tray assembly 62 is inserted into printer 10 as shown in FIGS. 1 and 2, the forward edges of cheeks 26 and 28, labeled with reference numbers 52 and 54, respectively, abut the housing 16. Each cheek 26 and 28 has an opening 30 formed therein in a position to receive one of the bosses 20, 22 and such that the tray 14 is pivotal about the bosses 20, 22. Thus, boss 20 is received into opening 30 of cheek 26, and boss 22 is received into opening 30 of cheek 28. Openings 30 thus define a pivot axis parallel to the X axis about which tray 14 is pivotal between the storage position and the in-use position. This pivot axis for output tray 14 is illustrated in FIG. 5 as line $P_1$.

Similarly, input tray 12 has a pair of outwardly facing bosses 32 (only one of which is shown, FIG. 5), one on each of the outer lateral edges of tray 12 in proximity to the front edge 36 of the tray, which is shown in a dashed line in FIG. 5. Each cheek 26, 28 has an opening 34 formed therein in a position to receive a respective one of the bosses 32 on input tray 12, and such that the tray 12 is pivotal about the bosses 32 and thus movable between the in-use and storage positions. Openings 34 thus define a pivot axis parallel to the X axis about which tray 12 pivots between the printing and storage positions. This pivot axis for input tray 12 is illustrated in FIG. 5 as line $P_2$.

With reference once again to FIG. 4, it may be seen that the position of openings 30 is offset from the position of openings 34 in two different axes, namely, the X and Y axes. The amount of offset between openings 30 and 34 along the Y axis is shown by dimension T, and the amount of offset in the X axis is illustrated by dimension U. Stated in another way, the pivot axis for output tray 14 (i.e., line $P_1$) is offset from the pivot axis for input tray 12 (line $P_2$) along the X and Y axes as just described. The offset between the pivotal axes for the trays allows the trays 12 and 14 to be flipped upwardly relative to housing 16 from the in-use position shown in phantom lines in FIG. 4 and into the storage position shown in solid lines in FIG. 4. Because the pivot axes defined by openings 30 and 34 are respectively offset as described, the trays 12 and 14 will remain in the storage position, without the need for separate securement of the trays when they are "flipped up" into the storage position and until the trays are moved back into the print position. That is, given the mounting structures described above, the two trays remain in the storage position without any separate mechanical devices designed to hold them in that position. Moreover, both trays 12 and 14 may be moved from the in-use position to the storage position by moving only the lower tray, input tray 12, which pushes the upper tray, output tray 14, as the former is moved from the media processing position to the storage position.

When both trays 12 and 14 are in the in-use positions the upper surfaces of the trays, represented by reference numbers 70 and 72, respectively, in FIG. 2, define planes that are generally parallel to one another, although output tray 14 when unloaded is held at an angle a few degrees greater than the input tray 12 to accommodate "sag" of the output tray when weighted with media. Stated another way, in the in-use position the plane defined by surface 70 of the input tray 12 is roughly parallel to the plane defined by the surface 72 of output tray 14, although these planes are not necessarily parallel to the ground plane. Likewise, in the storage position, the two trays are maintained in substantially parallel positions—that is, the plane defined by surface 70 of input tray 12 is roughly parallel to plane of surface 72 of the output tray 14. Because the two trays are independently pivotally mounted to the cheeks 26, 28 (with the bosses described above), the output tray 14 may be flipped up into the second position to expose the input tray when it is in the first position, thereby allowing a user to better visualize the correct position for media placement on the input tray. This is especially advantageous with respect small media loaded onto the input tray, such as envelopes and the like, as described below.

As noted above, printer 10 occupies significantly less area when trays 12 and 14 are in the storage position than when the trays are in the in-use position. This difference is represented in FIG. 4 by the dimensions M and N along the Y axis. In the illustrated embodiment the amount of area occupied by printer 10 when the trays are in the storage position is between at least about 15 to 45% less than the area occupied when by printer 10 when the trays are in the in-use position. In the illustrated embodiment, the area occupied by printer 10 when the trays are in the storage position is at least about 30% less than the area occupied by printer 10 when the trays are in the in-use position. Stated another way, the area occupied by printer 10 when trays 12 and 14 are in the storage position is between about 15 to 45% less than the area occupied by printer 10 when the trays are in the media processing position, thus leaving more room on a desktop for other purposes.

Printer 10 includes apparatus for correctly positioning and aligning media on input tray 12 so that media, regardless of size, is fed into the printer in the correct position and orientation. The printer control system (not shown) is designed such that the printer may accommodate different sizes of media. However, the control system assumes that all media, regardless of size, will be oriented on input tray 12 with an edge of the media abutting a media edge alignment guide 38, which is visible in FIG. 7. Alignment guide 38 is fixed relative to printer 10 near the right edge of input tray 12 and establishes a datum point that the printer controller uses during printer operation. Turning to FIG. 3, a media width adjustment guide 40 is provided near the left edge of input tray 12 and is adjustably slidable along the X axis. As noted, printer 10 is designed to accept cut sheet media of different sizes. In some embodiments, media of different sizes may be placed on input tray 12 such that one edge of the media is aligned with and abuts media edge alignment guide 38. With media placed in this position, width adjustment guide 40 is slid into position such that it abuts the opposite edge of the media. An adjustably slidable media length adjustment guide 42 is also provided on input tray 12 (FIG. 3) and is slidably adjustable along the Y axis. An opening 48 is formed in output tray 14 to receive length adjustment guide 42 when the trays 12 and 14 are nested in the storage position, as shown in FIG. 8. In addition to being able to accommodate media of different length using length adjustment guide 42, the length of input tray 12 is also adjustable along the Y axis.

Figure 6:
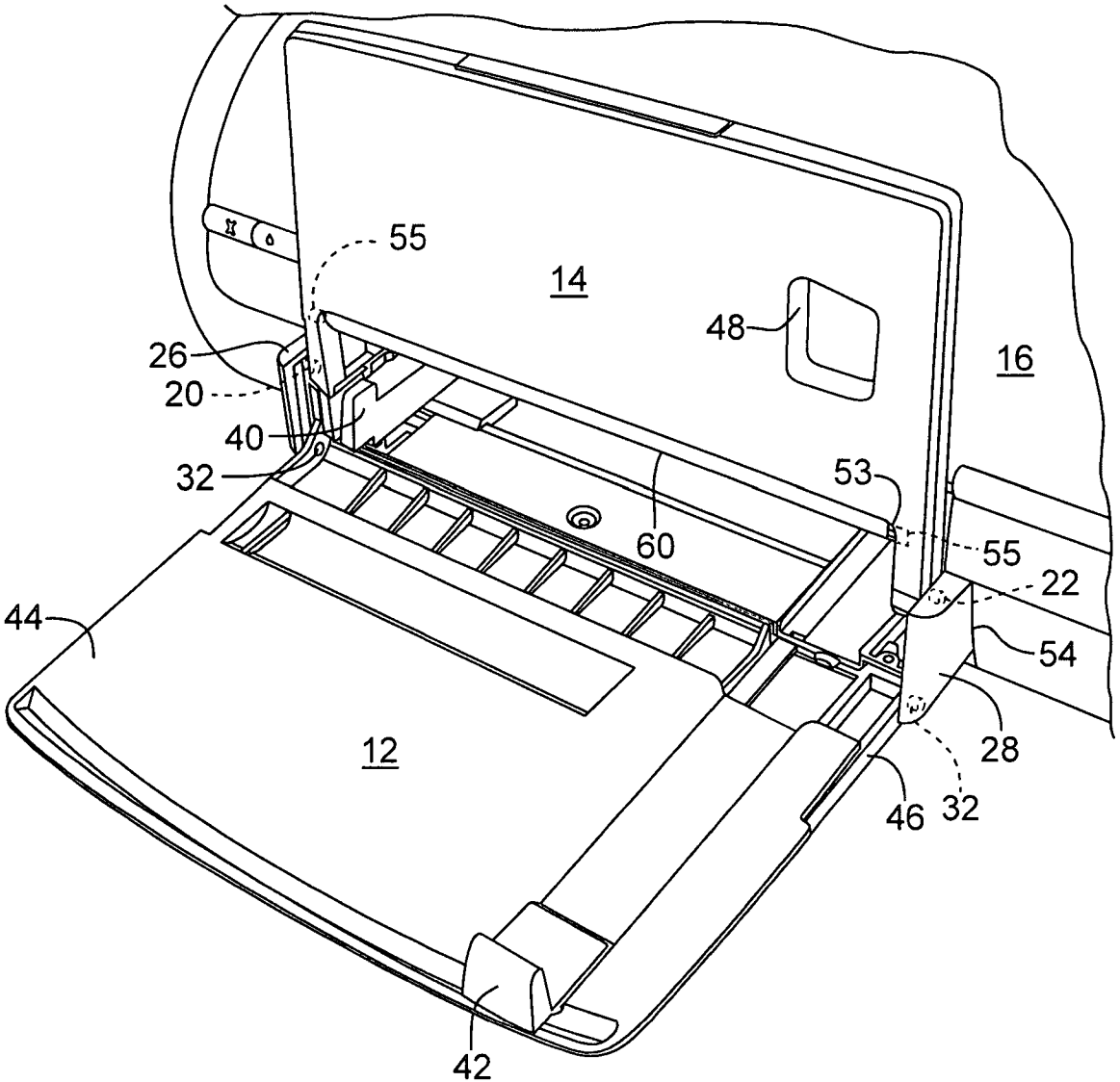
FIG. 6 is a semi-schematic perspective view of the hardcopy device illustrated in FIG. 1 in which the output tray has been folded up into the storage position and the input tray is in the in-use position, and in which the media input tray is in an extended position to accommodate relatively long media such as legal sized paper.

Turning to FIG. 6, input tray 12 is built with an upper portion 44 that is slidably assembled with a lower portion 46. Bosses 32 are formed as part of lower portion 46 of tray 12, and therefore it is lower portion 46 that is connected to cheeks 26 and 28. Upper portion 44 is attached to lower portion 46 to allow the upper portion to be slid relative to the lower portion along the Y axis. In FIG. 3, input tray 12 is shown with upper portion 44 slid inwardly toward printer 10 so that the tray has the shortest length. In FIG. 6, input tray 12 is shown with the upper portion 44 slid outwardly away from printer 10 to an extended position so that the tray has the maximum length. An internal stop (not shown) prevents upper portion 44 from being slid off lower portion 46.

In many printers, the input tray is not long enough to completely support long media, such as legal sized paper. As such, the "tail end" of long media hangs off the end of the input tray, or the length adjustment guides support only a portion of the tail end of the media. This can sometimes lead to media alignment errors as the media is fed into the printer. In the illustrated embodiment, because the entire upper portion 44 of input tray 12 may be moved into an extended position, even long media is completely supported by the input tray.

During printing operations, individual sheets of media are "picked" from available sheets on input tray 12 (such as a stack of cut sheet media) and are fed through the printer as described above, and are then output to output tray 14. Output tray 14, as shown in the FIGS., does not include alignment guides, although such alignment guides may be used in some alternate embodiments. However, to ensure that media is correctly output from printer 10 to output tray 14 without paper jams and the like, it may be desirable to provide a sufficiently uninterrupted output path that has no obstructions that could catch the leading edge of output media, or otherwise interrupt the smooth travel of media from the printer to the output tray. As such, the forward edge 24 of the output tray 14 extends inwardly into housing 16 toward the printzone. This allows processed media to be routed smoothly from the printzone to the output tray.

Figure 7:
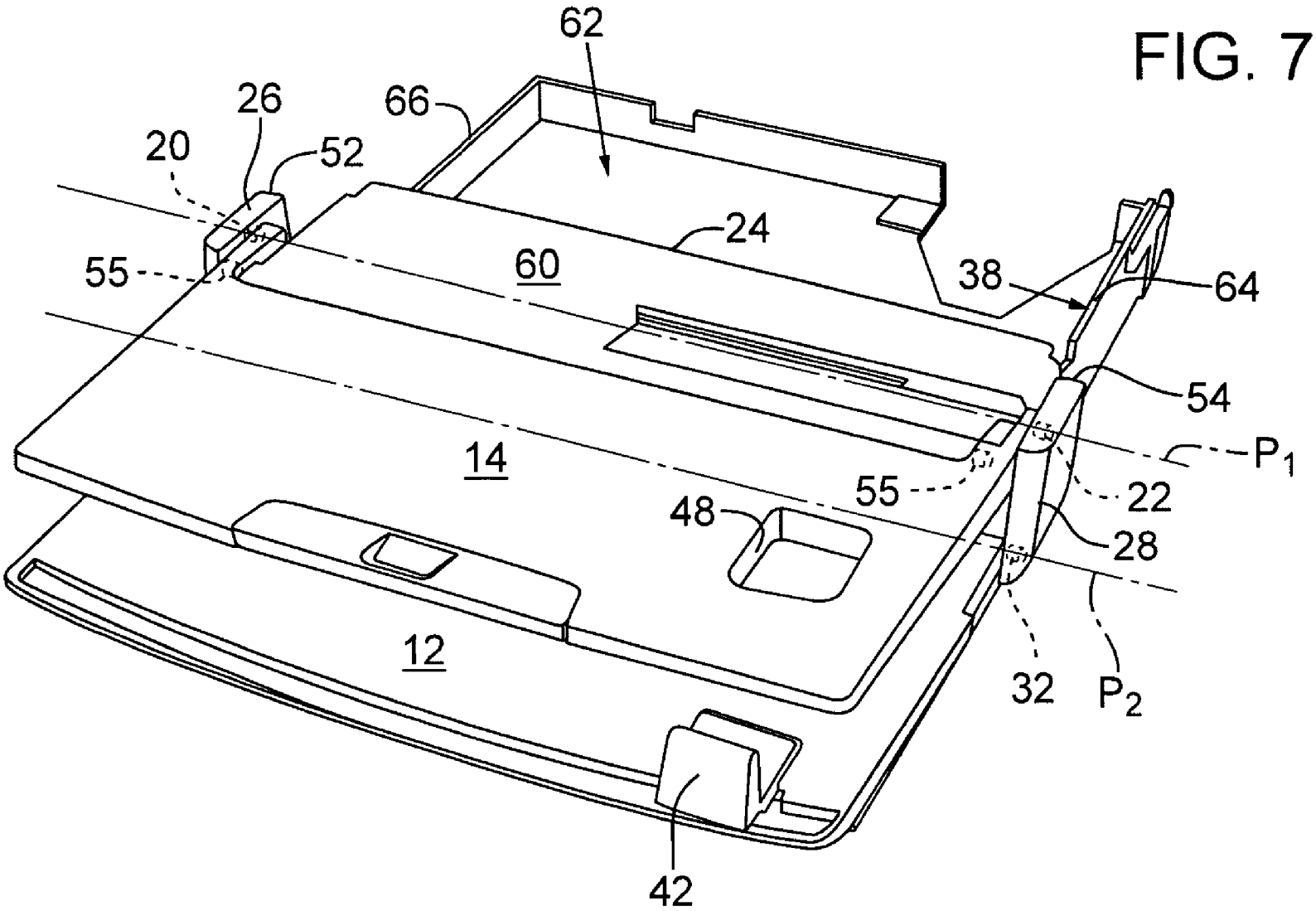
FIG. 7 is a front perspective view of the media input and output trays shown in FIGS. 1 through 6 with the tray assembly removed from the printer housing to illustrate selected components of the trays, with both the input and output trays in the use position.
Figure 8:
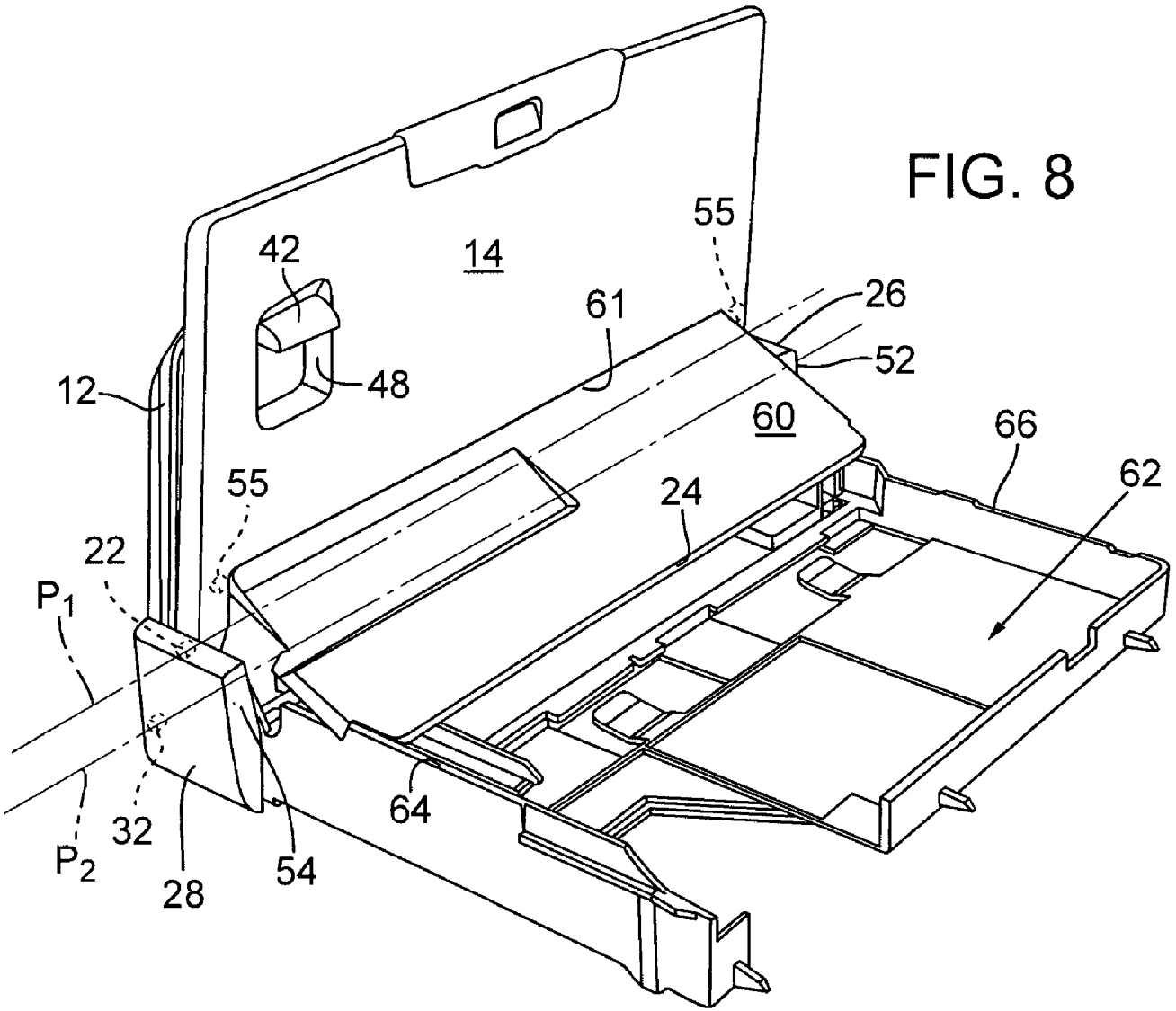
FIG. 8 is a rear perspective view of the media input and output trays and tray assembly shown in FIG. 7 showing both the input and output trays folded into the storage position.

As illustrated in FIG. 7, forward edge 24 of tray 14 extends inwardly beyond the outer edge of the housing, which is represented by a line extending (along the X axis) between the forward edges 52 and 54 of cheeks 26 and 28, respectively, which as noted above abut housing 16 when tray assembly 62 is inserted into printer 10 (although housing 16 is not shown in FIG. 7). The pivot axis about which tray 14 pivots, which is shown with line $P_1$, is located outwardly of the forward edge 24. As such, if tray 14 were formed in a unitary piece, those portions of the tray forward of line $P_1$ would pivot downwardly toward tray 12 as tray 14 were pivoted upwardly into the storage position. The portions of the tray forward of line $P_1$ would thus either strike tray 12 or media that may be stacked on the input tray, or at a minimum limit the width of the input tray opening and therefore obscure a user's view of the opening. A trap door 60 is thus provided in output tray 14 to eliminate these problems. Specifically, trap door 60 is hingedly connected to the output tray 14 with pair of bosses, one formed on each opposite side of the trap door in a position corresponding to an opening formed in the opposite edges of the output tray, in the same manner as bosses 22 and openings 30 described above. One boss 53 and opposed opening 55 are illustrated in FIG. 6. The trap door 60 is thus pivotally hinged to tray 14 for pivotal movement about the axis defined by openings 55. As output tray 14 is rotated upwardly into the storage position, the forward edge 24 of tray 14, which is a part of trap door 60, remains spaced apart from the input tray 12. Accordingly, when output tray 14 moved into the storage position, those portions of the tray that are located forward of line $P_1$ do rotate downwardly toward tray 12 and thus do not obstruct a user's view of the input tray 12.

As shown in FIG. 8, the input trays 12 and 14 are assembled in a tray assembly denoted generally with reference number 62. Tray assembly 62 is slidably inserted into printer 10 as shown in FIG. 1, and is removable as shown in FIG. 7. Tray assembly 62 includes cheeks 26 and 28, and further includes opposed upright rails 64 and 66, which support the outer lateral edges of trap door 60. It will be appreciated that as input tray 14 is moved from the in-use position to the storage position (i.e., from the position shown in FIG. 7 to the position shown in FIG. 8), trap door 60 pivots about its connection to output tray 14 (at bosses 53 and openings 55) and the forward edge 24 of tray 14 slides along rails 64 and 66. At the same time, the rearward edge 61 of trap door 60 rotates upwardly, away from input tray 12. When this occurs, the distance between the forward edge 24 and the plane defined by upper surface 70 of input tray 12 when in the in-use position is substantially the same regardless of whether tray 14 is in the in-use position or storage position. Because the rearward edge 61 rotates upwardly away from input tray 12, a user's view of and access to the input tray 12 is unhindered by any part of the output tray. Stated another way, the separation distance between the plane of surface 70 and forward edge 24 is the same regardless of whether output tray 14 is in the in-use position or the storage position. As a result, and as shown in FIG. 6, the media input tray 12 and the associated alignment guides 40, etc. are clearly visible to a user when tray 14 is flipped upwardly into the storage position. Trap door 60 thus allows the user to visualize the correct position for all types of media, especially small media such as envelopes. While printer 10 illustrated herein utilizes a removable tray assembly 62, it will be understood that the input and output tray and their functionality may be accomplished without a removable assembly.

High quality print jobs rely upon may factors, including correct initial positioning of the media on input tray 12. Despite input tray 12 having a variety of media alignment guides as described above, the proper initial position of media on the input tray is not always intuitive to users, especially new users who may not have used the device in the past and may not be familiar with its proper operation. If media is improperly aligned on the input tray, print errors such as incorrect margins may result, even to the point where the print margins extend beyond one edge of the media. Accordingly, trap door 60, by making the correct media positioning immediately visible, assists in reducing print errors caused by improper media placement.

Although various embodiments of the present invention have been described, it will be appreciated by one of ordinary skill in this art that the spirit and scope of the invention is not limited to those embodiments, but extend to the various modifications and equivalents as defined in the appended claims.

The invention claimed is:

1. A hardcopy device for processing media, comprising:

an input tray configured to pivot about a first axis between a first position and a second position and including a movable media guide;

an output tray configured to pivot about a second axis between a first position and a second position, the output tray including an opening configured to receive the guide when the input tray and the output tray are in the second positions;

wherein the input tray and the output tray are parallel in the first and second positions.

2. The hardcopy device according to claim 1 wherein the first pivot axis and the second pivot axis are parallel but offset relative to one another.

3. The hardcopy device according to claim 2 having a media travel axis that is transverse to the first axis and the second axis and the first axis and the second axis are offset relative to one another along the media travel axis.

4. The hardcopy device according to claim 2 wherein a terminal end of the input tray extends on a first side of a vertical plane containing the first axis in the first position and on a second side of the vertical plane in the second position such that the input and output trays are maintained in the second positions without independent securement.

5. The hardcopy device according to claim 1 wherein the input tray and the output tray are operably coupled to one another during movement of the input tray from the first position to the second position which causes movement of the output tray from the first position to the second position.

6. The hardcopy device according to claim 1 wherein the output tray is configured to pivot between the first position and the second position while the input tray is in the first position.

7. The hardcopy device according to claim 1 including a trap door pivotally connected to the output tray such that when the output tray is in the second position the trap door lies in a plane that is not parallel to a plane of the output tray.

8. The hardcopy device according to claim 7 wherein the output tray and the trap door are coplanar when the output tray is in the first position.

9. The hardcopy device according to claim 2 wherein the output tray includes a forward edge forward of the second pivot axis, and wherein the forward edge is spaced apart from a plane defined by the input fray by a distance that is the same when the output tray is in the first or second positions.

10. A hardcopy device, comprising:

an input tray connected to the hardcopy device and pivotally movable about a first pivot axis between a processing position wherein a top surface of the input tray is horizontal and a storage position;

an output tray connected to the hardcopy device above the input tray and pivotally movable about a second pivot axis between a processing position so as to receive media discharged from a front of the device and a storage position; and wherein the first pivot axis is offset relative to the second pivot axis and wherein a terminal end of the input tray extends on a first side of a vertical plane containing the first axis in the processing position and on a second side of the vertical plane in the storage position so that when the input tray and the Output tray are in their storage positions the trays are held in their storage positions.

11. The hardcopy device according to claim 10 wherein the input tray defines an input tray plane and the output tray defines an output tray plane, and wherein the input tray and the output tray are configured such that the input tray plane and the output tray plane are parallel when the trays are in their processing positions.

12. The hardcopy device according to claim 11 wherein the input tray and the output tray are configured such that the input tray plane and the output tray plane are parallel when the trays are in the storage positions.

13. The hardcopy device according to claim 12 wherein the output tray includes an edge forward of the second pivot axis that is spaced apart from the input tray by a distance when the output tray is in its processing position and is spaced apart from the input tray by the distance when the output tray is in its storage position.

14. The hardcopy device according to claim 10 configured for transporting media through the hard copy device along a media axis and wherein the media axis is transverse to the first and second pivot axes, and wherein the first pivot axis is offset relative to the second pivot axis along the media axis.

* * * * *

UNITED STATES PATENT AND TRADEMARK OFFICE

CERTIFICATE OF CORRECTION

PATENT NO. : 7,243,915 B2
APPLICATION NO. : 10/700806
DATED : July 17, 2007
INVENTOR(S) : Howard G. Wong et al.

It is certified that error appears in the above-identified patent and that said Letters Patent is hereby corrected as shown below:

In column 7, line 33, in Claim 9, delete “fray” and insert -- tray --, therefor.

In column 8, line 13, in claim 10, delete “Output” and insert -- output --, therefor.

In column 8, line 28, in Claim 13, after “its” insert -- media --.

Signed and Sealed this

Nineteenth Day of August, 2008

JON W. DUDAS
*Director of the United States Patent and Trademark Office*